US006109547A

United States Patent [19]

Ritsche

[11] Patent Number: 6,109,547

[45] Date of Patent: Aug. 29, 2000

[54] MEDIA DISPENSER

[75] Inventor: Stefan Ritsche, Radolfzell, Germany

[73] Assignee: Ing. Erich Pfeiffer GmbH, Radolfzell, Germany

[21] Appl. No.: 09/212,911

[22] Filed: Dec. 16, 1998

[30] Foreign Application Priority Data

Dec. 17, 1997 [DE] Germany ..... 197 56 090

[51] Int. Cl.[7] ..... G05B 7/32

[52] U.S. Cl. ..... 239/337; 239/333; 239/569; 222/22; 222/38; 222/321.9; 222/538

[58] Field of Search ..... 239/333, 337, 239/490, 491, 569; 222/14, 16, 22, 30, 33, 36, 38, 321.7, 321.9, 536, 538

[56] References Cited

U.S. PATENT DOCUMENTS

| | | | |
|---|---|---|---|
| 3,148,806 | 9/1964 | Meshberg . | |
| 4,234,127 | 11/1980 | Tada et al. . | |
| 4,669,665 | 6/1987 | Shay . | |
| 4,865,230 | 9/1989 | Tugwood . | |
| 5,098,603 | 3/1992 | Perlman | 222/538 X |
| 5,121,283 | 6/1992 | Jouillat et al. . | |
| 5,366,122 | 11/1994 | Guentert et al. | 222/401 |
| 5,584,417 | 12/1996 | Graf et al. | 222/82 |
| 5,791,518 | 8/1998 | Amann et al. | 222/538 X |

FOREIGN PATENT DOCUMENTS

| | | |
|---|---|---|
| 0782866 | 12/1996 | European Pat. Off. . |
| 2743544 | 7/1997 | France . |
| 4008069 | 9/1991 | Germany . |
| 4438375 | 5/1996 | Germany . |
| 19600123 | 7/1997 | Germany . |

*Primary Examiner*—Andres Kashnikow
*Assistant Examiner*—Robin O. Evans
*Attorney, Agent, or Firm*—Baker Botts L.L.P.

[57] ABSTRACT

A dispenser head (2) includes a pivotable discharge stud (17). The outlet duct (15) thereof is bounded by an inner body (22) and is located laterally adjacent to the stud axis (11). Thereby the medium may be discharged in atomized form while being multiply deflected.

36 Claims, 2 Drawing Sheets

1
2
6
12
41
7
64
65
33
11
10
60
61
5
14
16
32
3
17
8
23
18
13

59

57
58

MEDIA DISPENSER

TECHNICAL FIELD AND BACKGROUND OF THE INVENTION

The invention relates to a media dispenser. More particularly for flowable media, such as liquid, pasty, powdery or gaseous media. For discharge the dispenser may be held single-handed and simultaneously actuated by fingers of the same hand. The dispenser may consist solely of a discharge head or of two units to be actuated manually relative to each other. One of them comprises the discharge head and the other a base body including a pressure chamber, a pump body, a medium reservoir or the like.

To improve discharge, more particularly for an aimed at medium discharge, it is of advantage when the duct exit or medium outlet may be transferred into varying positions or axial orientations with respect the discharge head. For this the medium exit is arranged on a discharge body connected to the base body or head body of the discharge head via a bearing. So its positions relative to the head body can be varied either by detaching and reapplying, by flexing or by guidance thereon. If the discharge body comprises, similar to a tube, an outlet duct in its central axis up to the exit then residual medium can easily flow out also after medium discharge which results in contamination. Also environmental air may easily penetrate the outlet duct resulting in crusting of the residual medium or blockage of the duct. Furthermore, by its central position the outlet duct is bounded over its circumference uniformly dimensionally rigid. Should a blockage occur, it can therefore hardly be made pervious for the medium by resilient deformation of the discharge body.

OBJECTS OF THE INVENTION

An object of the invention is to provide a dispenser in which the disadvantages of prior art configurations or of the kind as described are avoided. Another object is to ensure a favorable flow response of the medium within the discharge head with high functional reliability.

SUMMARY OF THE INVENTION

According to the invention within the discharge body at least one duct section of the outlet duct is provided off-center or eccentrical or transverse to the center axis of the discharge body. Therefore, as regards the full cross-sections of the discharge body, this section adjoins a cross-sectional portion of reduced wall thickness. This relatively thin wall is able to respond resiliently pliantly slightly to fluctuations in pressure and thus damp these pressure fluctuations. Particularly when the wall thickness amounts to less than 3 mm, 2 mm or 1,5 mm. If this duct section is offset laterally relative to adjoining duct sections, e.g. relative to the exit then the medium may be deflected one or more times prior to discharge. If within the discharge body the outlet duct comprises a feed duct oriented transverse to the center axis of the discharge body then the cited duct sections are provided downstream of this feed duct.

The cited duct section may be bounded in one part or in two parts, e.g. between inner and on outer circumferential faces whereof the latter is formed by a core body inserted in the discharge body. The medium exit too, may be associated with a corresponding flow-influencing nozzle core spaced from the core body or adjoining thereto. The so formed inner body is inserted in the discharge body in a direction which is other than opposite to the flow direction e.g. transverse or codirectional with the flow direction. Although the medium exit may be located transverse to the main flow direction in the discharge body, it is expediently oriented parallel thereto. The inner body is suitable as an element strengthening or reinforcing the discharge body.

The discharge body comprises at the free end a transverse or end wall fixedly connected to the adjoining jacket of the discharge body or in one part therewith and capable e.g. to prevent the inner body from being forced out of the discharge body in the flow direction. If this wall is penetrated by the medium exit or by the associated nozzle duct the width thereof may be substantially smaller than the inner width of the adjoining section of the discharge body or the outer width of the core body. The nozzle duct is maximally as long as five or three times its largest diameter.

The bearing connecting the head body to the discharge body comprises at one or each of both these bodies two separate bearing members which are mutually spaced, e.g. a mandrel enveloped by a shell or inner surface so that despite the compact design a very secure hold free of motion play is assured, e.g. for introducing the discharge body into an opening or body opening such as the throat cavity of a human patient.

In the rest position, in the position oriented opposite thereto and/or in any intermediate position the discharge body may be held in place by almost positive locking. Expediently this may be overcome by a correspondingly large force acting on the discharge body. Therefore a freely protruding spring member, for example, a bending spring, provides the locking member.

The stroke actuation of the discharge head may also be lockable relative to the other unit, more particularly as a function of the positioning of the discharge body. The associated latching or stop member may be the free end of a straight, freely protruding arm. The abutting face is curved, particularly about the bearing axis of the discharge body.

The bearing body of the discharge body which directly engages the head body is in one part with those sections of the discharge which bound the remaining outlet duct. Thereby a very secure connection and, where necessary, a high dimensional rigidity is achieved for a miniature design.

For constricting, widening or closing the flow cross-sections a valve may be associated with the outlet duct. If the discharge head is arranged on an actuating plunger the valve is disposed downstream of this plunger or within the head body respective the discharge body while being manually actuatable by a handle. For example, this valve may be more or less opened or totally closed as a function of the positions of the discharge body.

For recognizing whether the dispenser has already been actuated after its production, means are provided for signaling such a first-time use. For example, members such as break-off members may be provided which on actuation of the discharge head, on displacement of the discharge body and/or on opening of the valve are translated into a non-returnable position thus indicating that the cited actions have taken place.

Reference is made to U.S. Pat. No. 547,041, U.S. Pat. No. 549,458 as well as to U.S. Pat. No. 785,029 regarding incorporation of their features and effects in the present invention.

BRIEF DESCRIPTION OF THE DRAWINGS

Embodiments of the invention are explained in more detail in the following and illustrated in the drawings in which.

DETAILED DESCRIPTION

Figures 1, 2, 3:
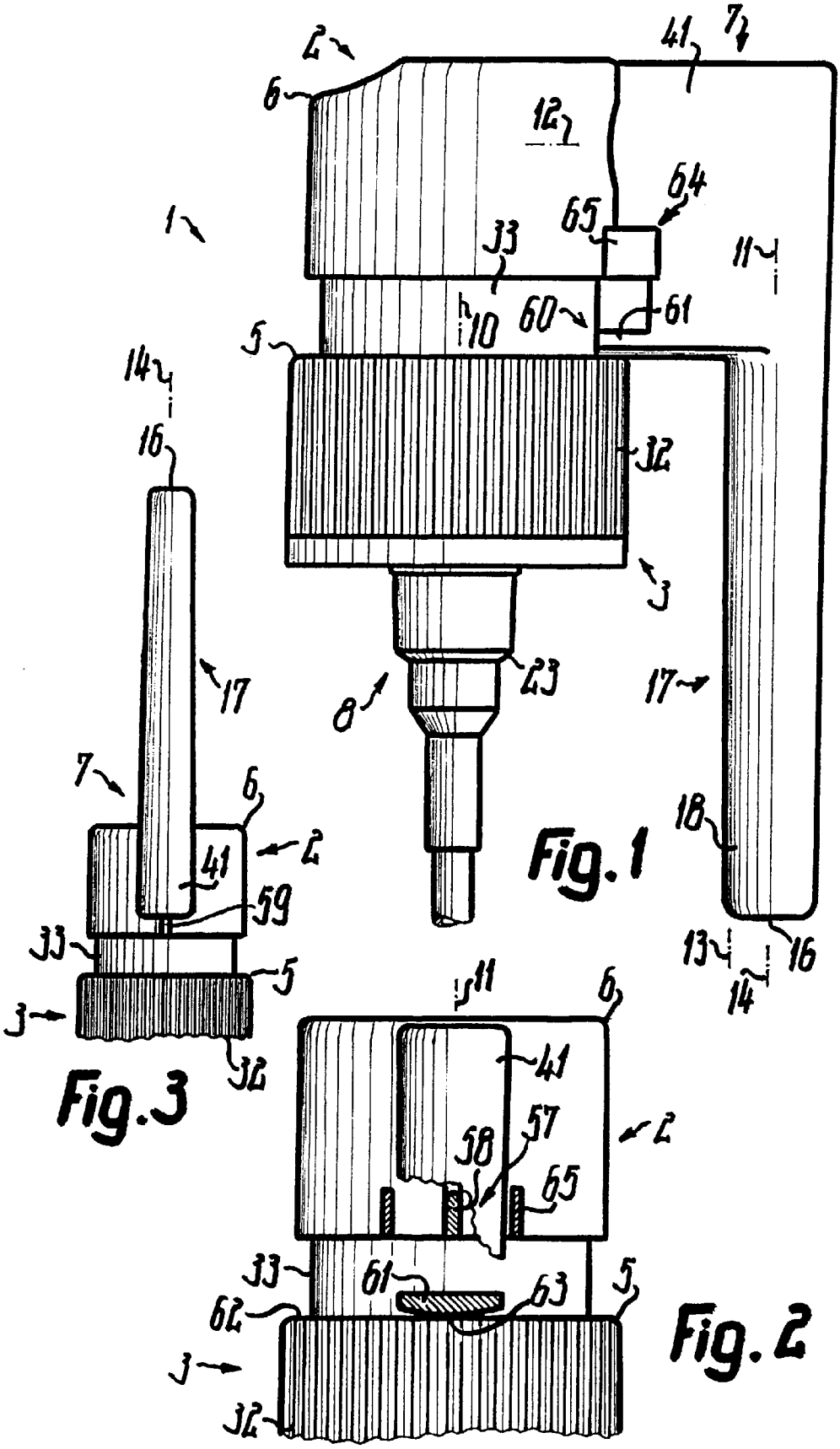
FIG. 1 is a side view of the dispenser according to the invention in its unused initial position.
FIG. 2 is a detail of the dispenser seen from the right in FIG. 1.
FIG. 3 is the detail shown in FIG. 2 but in a discharge position and in a smaller scale.
Figure 4:
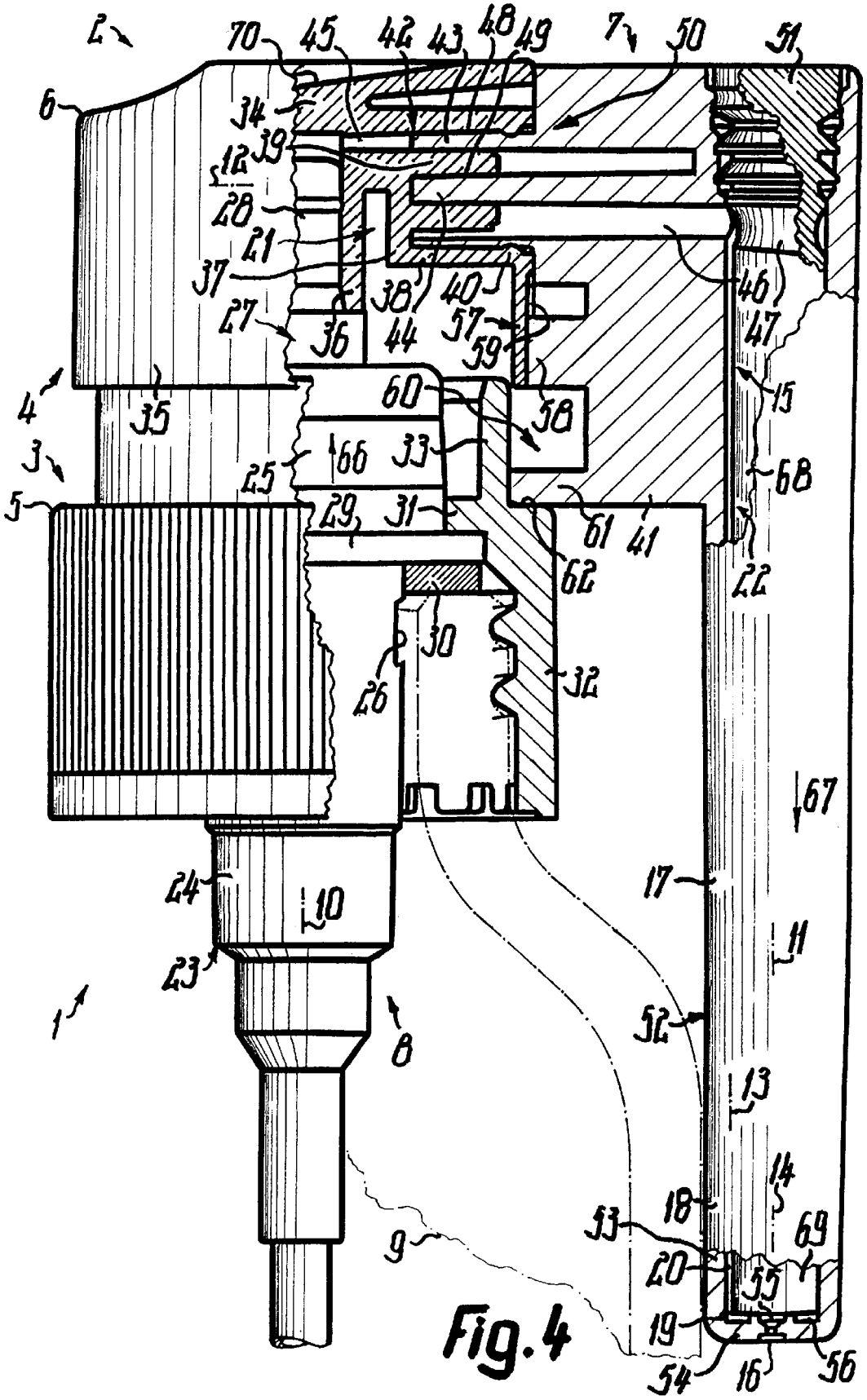
FIG. 4 shows the dispenser as in FIG. 1 but partly in cross-section.

The dispenser 1 may consist exclusively of a discharge head 2 to be arranged directly on the neck of a flask or as shown in FIGS. 1 to 4 on one of two mutually movable dispenser units 3, 4. Unit 3 comprises a cap-shaped base body 5 for securing or tensioning the dispenser 1 on the bottleneck of a reservoir 9. Unit 4 comprises likewise a base body or cap-shaped head body 6 permanently axially overlapping body 5 and provided on its outside with a discharge body 7 spaced from body 5. Body 5 serves to secure a preassembled pump such as a thrust piston pump directly axially tensioned with body 5 with respect to the reservoir bottleneck. Compressing units 3, 4 results under shortening of the dispenser 1 in discharge actuation via an actuating and pump stroke. Thereafter on release of the actuating force units 3, 4 or base bodies 5, 6 return by spring force to their initial position via a return stroke.

Units 3, 4, bodies 5, 6 and reservoir 9 are located in a main or head axis 10. By its free end or outlet section the discharge body 7 defines a section axis 11 permanently laterally offset from axis 10 and located laterally outside of bodies 5, 6, 9 when seen parallel to axis 10. Bodies 6, 7 are connected to each other in a connecting axis 12 oriented at right angles transverse to axes 10, 11 and intersecting them. Furthermore body 7 defines in its downstream end portion an exit axis 13 laterally offset from axes 10, 11 or located permanently therebetween. Axis 13 is parallel to axis 11. Axis 11 and axis 13 are parallel to axis 10 in two mutually counterdirected positions of body 7. Body 5 defines at its end a duct axis 14 which may be located in axis 11, laterally offset therefrom or oriented transverse to axis 11.

A supply duct leads from the pressure chamber of pump 8 through bodies 6, 7 and forms within body 7 an outlet duct 15 which is environmentally open with a medium exit 16, for example, an atomizer nozzle. The downstream duct sections 19, 20 of duct 15 are laterally offset from axis 14, adjoin each other at angles and issue directly into the inlet of the nozzle bore of exit 16. Section 20 is located in axis 13 and exit 16 in axis 14.

Bodies 6, 7 are interconnected via a connection, for example, a bearing 21, such as a slide bearing, or a flexible or elastic one-part connection as formed e.g. by a bendable tube. Separate and spaced from bearing 21 an oblong inner body 22 is located fully within body 7. Body 22 like body 7 bounds duct 15 up to the nozzle duct. Pump 8 comprises a casing 23 extending into reservoir 9. The casing parts 24, 25 are firmly connected with bodies 5, 9 and axially tensioned between these bodies. The longer part 24 protrudes into reservoir 9 and bounds by its circumference the pressure chamber. Into part 24 medium may be sucked via a riser tube from the bottom region of reservoir 9 on the return stroke.

Casing part 25 is firmly connected to part 24 via a snap connector. Part 25 is located outside of reservoir 9 and overengages the downstream end of part 24 at both the outer circumference and the inner circumference. The jacket of part 24 is penetrated by an opening of a vent 26 located within the reservoir space. Thereby atmospheric air from outside the dispenser 1 may be sucked into reservoir 9 through casing 23 via a venting valve closed in the initial position. Unit 4 comprises a piston unit 27 including a pump piston which is sealingly displaceable in casing 24 and bounds the pump chamber at an end. The piston is arranged on a ram or rod 28 like an outlet valve is which operates as a function of pressure. Rod 28 traverses cover 25 and carries body 6 at its outer end. Unit 27 may comprise both valve elements or valve seats of the outlet valve and in addition a movable valve element of the venting valve, the other valve element of which is formed by cover 25.

Casing 24 which may also be in one part with the end section 25 comprises at the cover 25 an annular flange 29 which protrudes radially outwards beyond both parts 24, 25. Flange 29 is tensioned against the end of the reservoir by body 5 with a seal 30 in the shape of an annular disk interposed. Body 5 adjoins the end of flange 29 facing away from reservoir 9 and the outer circumference of cover 25 connecting thereto by a flange 31 protruding radially inwards and having the shape of an annular disk. Seal 30 too, may adjoin the outer circumference of part 24 directly adjacent to flange 29 with radial tension. From flange 31 a jacket 32 of the one-part body 5 protrudes toward reservoir 9. Between its ends and spaced therefrom shell 32 forms at its inner circumference a fastener, for example a female thread, a resilient snap member or the like which fixedly engages a corresponding counter member at the outer circumference of the reservoir neck.

Instead of body 5 a metallic crimp ring may directly adjoin flange 29 and a remote counter shoulder of the reservoir neck. A further jacket 33 protrudes away from reservoir 9 from flange 31. The inner and outer circumferences of shell 33 are displaced radially inwards relative to those of shell 32. Shell 33 spacedly surrounds part 25 at the outer circumference but does not axially protrude over part 25. Sections 31 to 33 inclusive the fastener are in one part with each other. Each of parts 24, 25 is likewise in one part. Within part 24 an inlet valve may be provided which opens toward the pump chamber and recloses as a function of medium pressure.

The one-part head body 6 comprises at its outer end remote from body 5 an end wall 34 which at the outer circumference transits into a jacket 35 directed against body 5 and into a socket 36 radially spacedly located within shell 35. Socket 36 is linearly or axially plugged onto rod 28 with stop limiting. Rod 28 is traversed by the supply duct. Thereby body 6 may be removed non-destructively from unit 3. Shell 35 closely and permanently envelopes shell 33, but not shell 32 which is slightly wider than shell 35. The outside of wall 34 forms a pressure or actuating handle. The other and remote handle may be formed by the bottom of reservoir 9 or by the circumference thereof.

The hinge or bearing 21 comprises two bearing members 37, 42 mutually movable about axis 12. Axis 12 is stationary relative to bodies 6, 7. Bearing member 37 is in one part with body 6, is located between shells 35, 36 and adjoins shell 36 only by part of its circumference and shell 35 by its full circumference. Member 37 comprises two individual members located coaxially in each other, namely a sleeve-shaped bearing mandrel 39 and a bearing sleeve 38 radially spacedly surrounding mandrel 39. Shell 38 is longer than thorn 39. Thorn 39 freely protrudes into shell 38 towards shell 35 so that its end is set back relative to the outer circumference of body 6. Thorn 39 freely protrudes from the bottom of shell 38. This bottom is radially spaced from shell 36. Thereby bearing 21 is located totally within shell 35. The bearing member 42 of body 7 correspondingly comprises a head 41 with two separate members, namely a bearing sleeve 43 and a bearing mandrel 44 located therein. Thorn 44 engages inside the bore of thorn 39. Sleeve 43 engages in the annular gap between members 38, 39. Members 43, 44 and members 38, 39 freely protrude opposingly and are in one part with a bearing head 41.

For mutually axially securing bodies 6, 7 without motion play a connection, for example a snap-connector 40 is provided which radially resiliently snaps into locking position on insertion of member 42. Connector 40 is provided only between the mutually opposing circumferential faces of sleeves 38, 43 and directly adjacent to shell 35. Bearing 21 is traversed by feed ducts 45, 46 which directly adjoin the bore in shell 36 or the supply duct and which are bounded by all bearing members 38, 39, 43, 44. The upstream duct 45 adjoining sleeve 36 frontally issues at the bearing member 43 and is continued into head 41, namely into duct 46, between the circumferential faces of the members 39, 43 sliding on each other. Duct 46 extends up to the outer circumference of inner body 22. Both ducts 45, 46 are eccentric relative to axis 12 and issue into a distribution chamber 47 which is annular about axis 11. The width and/or depth of chamber 47 may be come larger the further away it is from duct 46.

Due to the configuration as described the bearing members 37, 42 directly adjoin and radially support each other with three pairs of bearing or sliding faces 48, 49. Member 43 adjoins the mutually opposing circumferential faces of both members 38, 39. Member 44 adjoins the inner circumference of member 39. Thorn 44 may axially abut the bottom of the bore of member 39. For radial spring suspension of the bearing faces or the snap connector 40 a gap may be provided between sleeve 38 and wall 34. This gap is open toward body 7. Thus sleeve 38 is freely exposed over its full circumference and over most of its length. Only the inner or outer end of shell 38 directly adjoins the remaining body 6.

Bearing 21 also forms a valve 50 with which the flow communication between ducts 45, 46 can be shut off and reopened. One pair of the bearing faces is therefore traversed over one or more parts of its circumference by a valve duct. This can be a groove in the inner circumference of sleeve 43 or formed by the upstream end section of duct 46. By rotating body 7 the valve duct is brought into and out of coincidence with duct 45. Valve 50 is only open in the position shown in FIG. 3, but could also be open in intermediate positions. In the position shown in FIGS. 1 and 4 valve 50 sealingly closes. Due to the resilient design of wall 34 the bearing faces 48, 49 too may sealingly adjoin without separate sealing members.

The interengaging members of connector 40 then form a seal. Duct 46 may be an annular groove surrounding thorn 44. From the groove bottom face a branch duct leads to duct 15 or to chamber 47. Thus already around thorn 44 a calming chamber is given which is significantly widened relative to duct 45.

Body 7 consists of but two components, namely head 41 including the exit section 17 and inner body 22. Body 22 is inserted in flow direction of duct 15 into a length opening of head 7 and has at the rear end a widened head 51. Head 51 firmly and sealingly engages head 41 directly by circumferential profiles. Thus its end face is located at the outside of head 41. From plate-shaped head 41 a socket or tube 52 protrudes in axis 11 towards exit 16. This tube jacket 53 surrounds body 22 over its full length and forms the outlet section 17 as connecting to head 41. At the free end shell 53 transits in one part into an annular end wall 54 oriented radially inwards and traversed by nozzle duct 55. Duct 55 is bounded in one part and its outer end forms orifice 16. The downstream end face of body 22 bounds commonly with the inside of wall 54 the duct section 19 oriented transverse to axes 10, 11, 13, 14.

The outer circumference of body 22 bounds commonly with the inner circumference of shell 53 the duct section 20 located in axis 13. Section 20 connects downstream directly to the significantly shorter section 19. Body 22 may be provided at the outer circumference with one or more longitudinal grooves forming duct section 20. The flow cross-sections of sections 19, 20 are significantly smaller than those of ducts 45 to 47. The flow cross-section of duct 15 may be constant from sections 46, 47 up to section 19. The stem of body 22 bounds duct 15 and is conically widened by a few degrees counter the flow direction. Thus in flow direction axis 13 of section 20 converges slightly with axis 11, 14 and diverges with axis 10 in the initial position.

Several duct sections 19 can be distributed about axis 14 and form a chamber 56 which is widened relative to section 20. In chamber 56 the medium is whirled or translated about axis 14 into a twisted flow discharged under atomizing from exit 16. The associated end of body 22 thus forms a nozzle core 69. Core 69 could be separate from the upstream section of the inner body which bounds duct 15 but is here in one part with this section. Core 69 abuts on the inside of wall 54 and bounds therewith chamber 56.

A lock 57 secures body 7 in at least one position, such as the initial position and/or at least one discharge position. The lock members 58, 59 are in one part with bodies 6, 7. Member 58 of body 7 is a web-like resilient tongue 58 countersunk in body 7 and oriented parallel to axis 12 against body 6 or shell 35. The free tongue end resiliently snaps into a latching recess 59 providing a lock reception in the outer circumference of shell 35. Both side faces, the two transverse edge faces and the end edge of member 58 are free of contact with respect to body 7. Thus the end edge can be deflected about axis 12 by resiliently bending relative to body 7. Thereby the end edge snaps out of the groove-shaped recess 59 until it snaps into the next latching recess. In the position shown in FIG. 3 member 58 is located adjacent to the outside of wall 34. Member 58 is provided between axis 12 and 16 at the side of head 41 facing body 6. Member 58 is located between and spaced from the side faces of head 41. Bodies 6, 7 slide on each other by flat faces oriented transverse to axis 12. These slide faces radially outwardly adjoin members 38, 43 and snap connector 40. Lock aperture 59 may be open toward the free end of shell 35. Thus in a locking position member 58 is flush with this end face of shell 35. Locking is possible in any rotational position about axis 10.

A latch or blocker 60 safeguards the dispenser 1 against actuation. When body 7 is pivoted from its locked middle position, for example the initial position, in opposite directions about axis 12 the latch remains equally intact in each of the pivoting directions over a pivoting angle of at least 5° or 10°. By then increasing the pivoting angle firstly only a partial stroke of body 6 is possible. The full stroke is only possible from a pivoting angle of at least 30° or 40° onwards.

For that head 51 provides a catch or stop 61 in one part with head 41 and spacedly adjacent to member 58. Like member 58 also stop 61 freely protrudes toward axis 10 in the locked position. Latching member 61 is spaced further from axis 12 than member 58. Body 5 has a counter member 62 for stop 61. Member 62 is formed by the annular transition shoulder between shells 32, 33 and is located in the plane of end wall 31. The abutting face 63 of stop 61 remote from axis 12 is concentrically curved about axis 12, but may also have a curvature radius which is somewhat smaller as compared thereto. With the then eccentrical latching face 63 a tensioning parallel to axis 10 or radially to axis 12 is possible between members 61, 62. Stop 61 is located at the end of the bearing head 41 facing exit 16 and axially coincides with member 58. The planar side faces of head 41 are parallel to each other and tangentially adjoin the outer circumference of tube 52. Thus the longitudinal edge face of head 41 facing away from body 6 is rounded about axis 11. Latch 60 is effective in each rotative position about axis 10.

To recognize whether the dispenser 1 has already been used after assembly, namely for the socalled originality protection, means 64 are provided which comprise locking members like break-off members 65 on body 6. In the initial position both strap-type members 65 are located on both sides directly adjacent to the side faces as of head 41 according to FIGS. 1 and 2. The parallel webs 65 jut from the outer circumference of shell 35 and extend up to the free end face thereof. Member 59 is located between members 65. Irrespective of the direction in which body 7 is turned from its rest position one of members 65 needs to be broken off from body 6 by head 41. For these members 65 are connected via break points to body 6. These break points are located directly on the cylindrical outer circumference of shell 35.

The flow direction 66 in the conveyor or pump 8 is directed toward end wall 34. The flow direction 67 in outlet section 17 and in nozzle 16 is directed toward wall 54. Body 7 is rotatable over full rounds relative to body 6. Thus in FIG. 3 the flows 66, 67 are codirectional. Body 22 forms in direct connection to head 51 the chamber 47 or a mandrel-shaped core body 68. Body 68 bounds section 20 over its full length and continuously transits at the end into nozzle core 69. Thus duct section 20 extends up to the end face of this stem 68, 69. In the initial position section 17 is located directly adjacent to the outer circumference of reservoir 9 against which it may also rest with pretension. Thereby section 17 is oriented parallel to axis 10 and counter flow direction 66. When body 7 is then pivoted first lock 57 and then blocker 60 is released, only whereafter valve 50 is opened in turn. Only then an actuation of head 6 at handle 70 results in discharge of the medium from exit 16. At the end of the stroke path shell 35 may abut against member 62. Due to actuation of body 6 the medium in the pressure chamber is compressed so that it opens the outlet valve and then flows through plunger rod 28, ducts 45, 46, chamber 57, duct 15 and duct 55 in sequence. Due to the fact that duct 15 is not straightly linear but angled and in addition offset laterally relative to exit 16, favorable flow patterns are achieved despite nozzle 16 being manually movable.

Except for the cited resilient members components 6, 5, 7, 22 are inherently or dimensionally rigid and may be produced as parts injection-molded from a plastics material. Body 23 may also be in one part with body 5. Bodies 6, 7 too, may be connected to each other in one part and transit into each other via a film-type hinge or the like. The properties and effects discussed may be provided precisely or merely substantially or roughly as described and may also greatly deviate therefrom depending on the medium to be discharged.

What is claimed is:

1. A dispenser for releasing media comprising:

a discharge head including a head body and defining a head axis;

a discharge body including an exit section, a duct exit where the medium is released from said dispenser and a bearing head;

a bearing operationally mounting said bearing head on said head body, said exit section and said bearing head being commonly manually displaceable relative to said head body, and an outlet duct including said duct exit and traversing said exit section, said outlet duct defining flow axes including a duct axis and an exit axis, said exit section including an exit end located downstream and defining a free end bounding said duct exit, said exit end defining a central section axis and a flow direction oriented substantially parallel to said central section axis, said outlet duct including at least one duct section laterally displaced with respect to said central section axis when seen in cross-section through said exit end and transverse to said central section axis, said free end being in one part with said exit end, wherein said bearing head displaceably directly engages said head body at said bearing, said bearing head being in one part with said exit section.

2. The dispenser according to claim 1, wherein said discharge body defines a length extension including a major partial length and oriented substantially parallel to an axial plane of said head axis, said duct section extending along said section axis over said major partial length eccentrically with respect to at least one of said central section axis, and said exit axis.

3. The dispenser according to claim 1, wherein said duct section defines a section length extension and a spacing from said central section axis, said spacing being substantially constant over said section length extension and said section length extension being linear.

4. The dispenser according to claim 1, wherein said duct section is inclined with respect to said section axis by a few degrees.

5. The dispenser according to claim 1, wherein said exit section defines inner faces including a circumferential face and an end face, at least one of said inner faces bounding said duct section, said circumferential face being conically constricted toward and up to said exit end.

6. The dispenser according to claim 1 and further including a core body inserted into said exit section, wherein said core body bounds said duct section, said core body traversing said bearing head radially projecting over both said head body and said exit section.

7. The dispenser according to claim 6, wherein said core body is inserted through said bearing head into said exit section codirectionally with said flow direction.

8. The dispenser according to claim 1 and further including a nozzle wall, a nozzle core and a nozzle duct traversing said nozzle wall, wherein said nozzle duct is bounded in one part with said free end and said bearing head, said nozzle duct including an upstream end opposed by said nozzle core, nozzle core being inserted into said free end through said bearing head radially projecting over both said head body and said exit section.

9. The dispenser according to claim 8 and further including a whirler for swirling the medium, wherein said whirler is located between said nozzle duct and said nozzle core, said nozzle wall being in one part with said bearing head.

10. The dispenser according to claim 8 and further including a core body inserted in said exit section for bounding said duct section, wherein said nozzle core is a common component with said core body abutting against said nozzle wall, said core body traversing said bearing head.

11. The dispenser according to claim 8, wherein said at least one duct section includes first and second duct sections, said first duct section connecting downstream to said second duct section oriented transverse to said section axis and directly connecting to said nozzle duct, said nozzle wall being in one part with said exit section and said exit end.

12. The dispenser according to claim 1, wherein said exit end is an oblong tube defining a length extension, a stiffener separate from said oblong tube being included and contacting said oblong tube over at least two thirds of said length extension, said exit end including an end wall made in one part with said oblong tube.

13. The dispenser according to claim 1, wherein said duct exit and said bearing head are commonly displaceable with respect to said head body transverse to said head axis and said flow axes.

14. The dispenser according to claim 1 and further including a base body freely projecting into a medium reservoir in a projecting direction, wherein in an axial cross-section through said head axis said exit axis is orientable substantially parallel to said head axis, said medium reservoir including a bottle bulge and a bottle neck externally constricted relative to said bottle bulge and traversed by said base body, when freely projecting in said projecting direction said exit section externally contacting said bottle bulge and being radially spaced from said bottle neck.

15. The dispenser according to claim 1, wherein said exit axis is displaceable with respect to said head axis to achieve axis positionings, in at least one of said axis positionings said head axis and said exit axis being located in a common axial plane, a core body being inserted into said exit section and being freely exposed at said bearing head.

16. The dispenser according to claim 1 and further including a lock for releasably locking said discharge body with respect to said head body, wherein said lock includes first and second locking elements including a lock reception and a lock member, said locking member resiliently releasably engaging said lock reception, said bearing head including a bearing projection radially projecting over both said head body and said exit section, said bearing projection including a first projection end and a second projection end remote from and spaced from said first projection end parallel to said central section axis, said bearing head including said first locking element between and spaced from both said first and second projection ends.

17. A dispenser for releasing media comprising:

a discharge head including a head body and defining a head axis;

a discharge body including an exit section and a duct exit;

a bearing operationally mounting said exit section on said head body, and an outlet duct including said duct exit and traversing said exit section, said outlet duct defining flow axes including an exit axis and a duct axis, said exit section including an exit end located downstream and defining a free end, said exit end defining a central section axis and a flow direction, said outlet duct including at least one duct section laterally displaced with respect to said section axis when seen in cross-section transverse to said section axis, wherein said bearing interconnects said head body and said discharge body including a bearing head, said bearing head including a bearing member including first and second bearing faces, said first bearing face being radially spaced from said second bearing face, said first bearing face enveloping said second bearing face.

18. A dispenser for releasing media comprising:

a discharge head including a head body and defining a head axis;

a discharge body including an exit section and a duct exit;

a bearing operationally mounting said exit section on said head body, and an outlet duct including said duct exit and traversing said exit section, said outlet duct defining flow axes including an exit axis and a duct axis, said exit section including an exit end located downstream and defining a free end, said exit end defining a central section axis and a flow direction, said outlet duct including at least one duct section laterally displaced with respect to said section axis when seen in cross-section transverse to said section axis, wherein said lock member includes a lock tongue freely projecting into said lock reception and inherently resiliently deformable for releasing said lock, in a side view said lock tongue including free length edges including first and second length edges, said first length edge being remote from said second length edge, at least one of said length edges being freely exposed, in the side view at least one of said length edges being directed toward said head body.

19. A dispenser for releasing media comprising:

a discharge head including a head body and defining a head axis;

a discharge body including an exit section and a duct exit;

a bearing operationally mounting said exit section on said head body;

an outlet duct including said duct exit and traversing said exit section, said outlet duct defining flow axes including an exit axis and a duct axis, said exit section including an exit end located downstream and defining a free end, said exit end defining a central section axis and a flow direction, said outlet duct including at least one duct section laterally displaced with respect to said section axis when seen in cross-section transverse to said section axis, and a base body and a blocker for releasably locking said discharge head with respect to said base body, wherein said discharge head is operationally displaceable with respect to said base body when said blocker is released, said blocker including a stop located between said bearing and said exit end, when said blocker locks said discharge head said discharge body being displaceable with respect to said head body in counterdirectional motions.

20. The dispenser according to claim 19, wherein said stop includes an abutting face which is arcuated.

21. The dispenser according to claim 19, wherein said discharge head is rotatable about said head axis with respect to said base body when locked with said blocker.

22. A dispenser for releasing media comprising:

a discharge head including head body and defining a head axis;

a discharge body including an exit section and a duct exit;

a bearing operationally interconnecting said exit;

section and said head body, and an outlet duct including said duct exit and traversing said exit section, said outlet duct defining flow axes including an exit axis and a duct axis, said exit section including an exit end located downstream, said exit end defining a central section axis and a flow direction, and a feed duct connecting to said outlet duct within said bearing, wherein a valve is included and traversed by said feed duct, a handle being included on said discharge head for manually actuating said valve, said handle being directly manually displaceable relative to said head body.

23. The dispenser according to claim 22, wherein said handle is manually displaceable commonly with said bearing head.

24. A dispenser for releasing media comprising:

a discharge head including a head body and defining a head axis;

a discharge body including an exit section and a duct exit;

a bearing operationally mounting said exit section on said head body, and an outlet duct including said duct exit and traversing said exit section, said outlet duct defining flow axes including an exit axis and a duct axis, said exit section including an exit end located downstream and defining a free end, said exit end defining a central section axis and a flow direction, said outlet duct including at least one duct section laterally displaced with respect to said section axis when seen in cross-section transverse to said section axis, wherein said valve includes a first valve body and a second valve body operationally displaceable with respect to said first valve body, said bearing including a first bearing member including said first valve body and a second bearing member including said second valve body.

25. A dispenser for releasing media comprising:

a discharge head including a head body and defining a head axis;

a discharge body including an exit section and a duct exit;

a bearing operationally mounting said exit section on said head body, and an outlet duct including said duct exit and traversing said exit section, said outlet duct defining flow axes including an exit axis and a duct axis, said exit section including an exit end located downstream and defining a free end, said exit end defining a central section axis and a flow direction, said outlet duct including at least one duct section laterally displaced with respect to said section axis when seen in cross-section transverse to said section axis, and an indicator for displaying displacement of said discharge body, wherein means are provided for preventing resetting of said indicator after displacing said discharge body with respect to said head body.

26. The dispenser according to claim 25, wherein said indicator includes at least one break-off member severed on displacing said discharge body.

27. The dispenser according to claim 25 and further including a valve for controlling flow of the medium to said duct exit, wherein said indicator is actuated by opening said valve.

28. A dispenser for releasing media comprising:

a discharge head including a head body and defining a head axis;

a discharge body including an exit section and a duct exit;

a bearing operationally interconnecting said exit section and said head body; and an outlet duct including said duct exit and traversing said exit section, said outlet duct defining flow axes including an exit axis and a duct axis, said exit section including an exit end located downstream, said exit end defining a central section axis and a flow direction, wherein said bearing interconnects said head body and said discharge body including a bearing head, said bearing head including a bearing member including first and second bearing faces, said first bearing face being radially spaced from said second bearing face, said first bearing face enveloping said second bearing face.

29. A dispenser for releasing media comprising:

a discharge head including a head body and defining a head axis;

a discharge body including an exit section and a duct exit;

a bearing operationally interconnecting said exit section and said head body, and an outlet duct including said duct exit and traversing said exit section, said outlet duct defining flow axes including an exit axis and a duct axis, said exit section including an exit end located downstream, said exit end defining a central section axis and a flow direction, wherein said lock member includes a lock tongue freely projecting into said lock reception, in a side view said lock tongue including free length edges including first and second length edges, said first length edge being remote from said second length edge, at least one of said length edges being freely exposed, in the side view at least one of said length edges being directed toward said head body.

30. A dispenser for releasing media comprising:

a discharge head including a head body and defining a head axis;

a discharge body including an exit section and a duct exit;

a bearing operationally interconnecting said exit section and said head body, and an outlet duct including said duct exit and traversing said exit section, said outlet duct defining flow axes including an exit axis and a duct axis, said exit section including an exit end located downstream, said exit end defining a central section axis and a flow direction, and a base body and a blocker for releasably locking said discharge head with respect to said base body, wherein said discharge head is operationally displaceable with respect to said base body when said blocker is released, said blocker including a stop located between said bearing and said exit end, when said blocker locks said discharge head said discharge body being displaceable with respect to said head body in counterdirectional motions.

31. The dispenser according to claim 30, wherein said stop includes an abutting face which is arcuated.

32. The dispenser according to claim 30, wherein said discharge head is rotatable about said head axis with respect to said base body when locked with said blocker.

33. A dispenser for releasing media comprising:

a discharge head including a head body and defining a head axis;

a discharge body including an exit section and a duct exit;

a bearing operationally interconnecting said exit section and said head body, and an outlet duct including said duct exit and traversing said exit section, said outlet duct defining flow axes including an exit axis and a duct axis, said exit section including an exit end located downstream, said exit end defining a central section axis and a flow direction, wherein said valve includes a first valve body and a second valve body operationally displaceable with respect to said first valve body, said bearing including a first bearing member including said first valve body and a second bearing member including said second valve body.

34. A dispenser for releasing media comprising:

a discharge head including a head body and defining a head axis;

a discharge body including an exit section and a duct exit;

a bearing operationally interconnecting said exit section and said head body, and an outlet duct including said duct exit and traversing said exit section, said outlet duct defining flow axes including an exit axis and a duct axis, said exit section including an exit end located downstream, said exit end defining a central section axis and a flow direction, and an indicator for displaying displacement of said discharge body, wherein said indicator includes an indicator member separate from said discharge body and displaceably mounted on said head body.

35. The dispenser according to claim 34, wherein said indicator member includes at least one break-off member severed on displacing said discharge body.

36. A dispenser for releasing media comprising:

a discharge head including a head body and defining a head axis;

a discharge body including an exit section and a duct exit;

a bearing operationally interconnecting said exit section and said head body; and an outlet duct including said duct exit and traversing said exit section, said outlet duct defining flow axes including an exit axis and a duct axis, said exit section including an exit end defining a central section axis and a flow direction, and an indicator for displaying displacement of said discharge body, wherein said indicator includes an indicator member separate from said discharge body and displaceable relative to said head body, a valve being included for controlling flow of the medium within said dispenser, said indicator being actuated by actuating said valve.

* * * * *